US008066856B2

(12) United States Patent
Van Acker

(10) Patent No.: US 8,066,856 B2
(45) Date of Patent: Nov. 29, 2011

(54) SERVICE MODULE WITH AT LEAST ONE ANODE CLAMP AND MEANS FOR APPLYING A FORCE OR A SHOCK ON THE ANODE ROD

(75) Inventor: Alain Van Acker, Orchies (FR)

(73) Assignee: E.C.L., Ronchin (FR)

( * ) Notice: Subject to any disclaimer, the term of this patent is extended or adjusted under 35 U.S.C. 154(b) by 135 days.

(21) Appl. No.: 12/522,553

(22) PCT Filed: Mar. 19, 2008

(86) PCT No.: PCT/FR2008/000364

§ 371 (c)(1),
(2), (4) Date: Jul. 9, 2009

(87) PCT Pub. No.: WO2008/135653

PCT Pub. Date: Nov. 13, 2008

(65) Prior Publication Data

US 2010/0116653 A1 May 13, 2010

(30) Foreign Application Priority Data

Mar. 23, 2007 (FR) ..... 07 02143

(51) Int. Cl.
*C25B 9/02* (2006.01)
*C25C 3/10* (2006.01)

(52) U.S. Cl. ..... 204/297.08; 204/297.01; 204/297.06; 204/297.09; 204/297.1; 204/297.14; 204/297.16; 204/286.1; 204/288.6; 204/243.1; 204/244

(58) Field of Classification Search ..... 204/297.01, 204/297.06, 297.08, 297.09, 297.1, 297.14, 204/243.1, 244, 286.1, 288, 288.3, 288.6, 204/297.16
See application file for complete search history.

(56) References Cited

U.S. PATENT DOCUMENTS

| | | | | |
|---|---|---|---|---|
| 5,378,338 | A * | 1/1995 | Langon et al. | 204/247.4 |
| 7,779,580 | B2 * | 8/2010 | Van Acker et al. | 52/118 |
| 7,887,680 | B2 * | 2/2011 | Delcorde | 204/288.6 |
| 2002/0074224 | A1 * | 6/2002 | Piron et al. | 204/297.06 |
| 2004/0211663 | A1 * | 10/2004 | Gagne et al. | 204/280 |
| 2005/0211552 | A1 * | 9/2005 | Acker et al. | 204/247.2 |
| 2005/0266735 | A1 * | 12/2005 | Delescluse | 439/709 |
| 2006/0049054 | A1 * | 3/2006 | Van Acker et al. | 205/81 |
| 2006/0060469 | A1 * | 3/2006 | Delescluse | 204/243.1 |
| 2006/0137972 | A1 * | 6/2006 | Van Acker et al. | 204/194 |
| 2006/0290153 | A1 * | 12/2006 | Delescluse | 294/115 |
| 2008/0075572 | A1 * | 3/2008 | Van Acker et al. | 414/744.6 |
| 2008/0142357 | A1 * | 6/2008 | Delcorde | 204/297.01 |

* cited by examiner

*Primary Examiner* — Bruce Bell
(74) *Attorney, Agent, or Firm* — Dennison, Schultz & MacDonald

(57) ABSTRACT

A tending module for a series of electrolysis cells designed for the manufacture of aluminum by igneous electrolysis, each cell including a series of anodes provided with a metal rod designed to fix and electrically connect the anodes to a metal anode frame. The tending module includes a frame to be fixed to a mobile component, and at least one anode handling unit connected to the frame. The module also includes, integral with the anode handling unit, an activator that can exert at least one force or impulse on the anode rod, with a force such that, although the stem is firmly maintained in contact against the anode frame, the contact surfaces are moved in relation to each other by an amount sufficient for electrical contact to be improved. Advantageously, the activator is a jack or an impulse generator integral with the anode clamp.

27 Claims, 7 Drawing Sheets

SERVICE MODULE WITH AT LEAST ONE ANODE CLAMP AND MEANS FOR APPLYING A FORCE OR A SHOCK ON THE ANODE ROD

BACKGROUND OF THE INVENTION

The invention relates to aluminum production plants using igneous electrolysis according to the Hall-Héroult process. It especially relates to handling equipment used in said plants to handle the anodes while they are being replaced in the electrolysis cells.

Metallic aluminum is produced industrially by igneous electrolysis, namely by electrolysis of alumina in solution in a molten cryolite bath, known as an electrolyte bath, using the well-known Hall-Héroult process. The electrolyte bath is contained in tanks, called "electrolysis pots", comprising a steel container, which is coated on the inside with refractory and/or insulating materials, and a cathode unit located at the bottom of the pot. Anodes, typically made of is carbonaceous material, are partially immersed in the electrolyte bath. The assembly formed by an electrolysis pot, its anodes and the electrolyte bath is called an electrolysis cell.

The plants contain a great number of electrolysis cells laid out in line, in buildings called potrooms, and electrically connected in series using connecting conductors, in order to make the best use of the floor area of the plants. The cells are generally laid out so as to form two or more parallel lines which are electrically linked to each other by end conductors. The electrolysis current thus cascades from one cell to the next. The cells include series of anodes, each of which is in the form of an anode block connected to a metal rod, called an anode rod. The rod is generally rectangular in section so that one of its faces can be kept firmly in contact with an anode frame which extends over the entire length of the cell and carries the electrolysis current.

When operating, an electrolysis plant requires work on the electrolysis cells, in particular replacement of spent anodes by new ones, sampling of molten metal in the cells and sampling or top-ups of electrolyte. The most modern plants are equipped with lifting and handling units comprising an overhead travelling crane, which can be moved above and along the electrolysis cells, and a carriage on which is fixed a tending module comprising a frame that can be fixed to said carriage and a handling and servicing unit including several tools, such as shovels, clamps and hoists.

The tool designed for handling and moving loads such as anodes comprises a clamp suitable for grasping the load, called "a handling clamp" or an "anode clamp" During anode handling operations, this clamp is placed near the rod of the anode to be grasped, then closed on the rod so that the anode can be raised, moved, then positioned or put down at the desired place.

When replacing an anode on an aluminum electrolysis pot, it is often observed that the electrical contact between the anode rod and the anode frame is not satisfactory. But it is important for electrical contact at this level to be excellent, i.e. it must give a voltage drop, known as an "anode drop", that is as low as possible: an anode drop of 15 mV results in a significant loss of productivity for the pot, because of both the reduction of that part of the electrical power which is actually devoted to electrolysis, and the longer time taken for the anode to come up to operating power. Lastly, a very poor contact can lead to the creation of electric arcs likely to damage the contact surfaces.

Moreover, an insufficient electrical contact between the anode and the anode frame can be observed only several hours after replacing the anode, because it takes several hours of heating the anode unit before the electric current reaches its full capacity. So, as things stand today, over ten hours after fitting the anode, typically 16 hours, an operator comes to read the difference in voltage between the anode framework and the anode rod: if this voltage difference is higher than a critical value, the electrical contact between the rod and the anode frame needs to be modified.

With a view to improving safety, research has been carried out to limit the causes of staff having to work near danger zones. Among these causes is checking anode drop. It has therefore been attempted to eliminate such work, without giving up checking that the current passes properly between the anode frame and the anode rod at all times.

SUMMARY OF THE INVENTION

A first object according to the invention is a tending module for a series of electrolysis cells designed for the manufacture of aluminum by igneous electrolysis, each cell comprising a series of anodes provided with a metal rod designed to fix and electrically connect the anodes to a metal anode frame, said tending module comprising a frame to be fixed to a mobile component, typically a carriage moving on a travelling crane, and at least one anode handling unit connected to said frame, characterized in that it also comprises, integral with said anode handling unit, an activator that can exert at least one force or impulse on the anode rod, with a force such that, although the stem is firmly kept in contact against the anode frame, the respective contact surfaces of the rod and the anode framework are moved in relation to each other by an amount that is preferably as small as possible but sufficient for electrical contact to be improved. The expression "an activator that can exert at least one force or impulse" designates a means (fixed on or integral with the anode handling unit) that is designed to exert, directly or not, a force or an impulse on the anode rod, at least once, when the anode is positioned in the cell and the rod is linked to the anode frame and firmly kept in contact against it thanks the connector. The surface quality of these contact surfaces is probably modified but it is possible that the electrical contact can be improved before said modification of surface quality can be observed by conventional means. The intensity of the load or impulse must therefore preferably be defined or checked—primarily by observation of a weak anode drop, typically lower than a value ranging between 13 and 15 mV—on a case-by-case basis, by preliminary tests, on the particular spatial and mechanical configurations of the connections between the anode rods and the anode frame of a given electrolysis cell.

For each line of anodes, the anode frame appears as a profile with a rectangular section. The anode rod is generally prismatic in shape with a plane face designed to come into contact with the plane surface of the anode frame. Preferably, said activator exerts at least one force, or emits at least one impulse directed in a plane parallel to the contact plane between the rod and the anode frame.

Preferably, said activator is driven by at least one actuator that can move it from a position where said activator is not in contact with the anode rod, to a position where said activator is in direct or indirect contact (i.e. via adaptors), with the anode rod, and/or able to move in the opposite direction. It may turn out to be more effective to perform a relative movement between the contact surfaces of the anode rod and the anode framework which does not result solely in a simple translation but which also has a rotational component. In this case, the actuator is arranged so that the force applied to the rod, preferably directed in a plane parallel with the contact plane, is not directed vertically, but horizontally or obliquely, and not pointing towards said contact surface.

The tending module preferably includes a frame and a turret assembled on the frame so as to be able to swivel around a vertical axis and equipped with said anode handling unit. The anode handling unit advantageously includes at least one anode clamp assembled on an actuator, typically a hinged arm or a telescopic arm. Advantageously, said activator is integral with said anode clamp. In certain embodiments of the invention, the clamp actuator is also used to drive the activator. In other embodiments, a different actuator is used.

The applicant noted that the force—or impulse, or series of impulses—, in particular when directed in a plane parallel to the contact plane, makes it possible to generate one or more micro-movements parallel to the contact surface between the rod and the anode framework so that the contact surface undergoes a shearing load. Such a relatively low amount of energy is sufficient, in particular when shearing is used, to generate micro-movements which locally level and crush certain micro-asperities of the contact surfaces and/or rip off the oxide coatings which are poor conductors. The applicant noted with surprise that this phenomenon occurs although the rod is strongly held up against the anode framework by means of a connector such as that described in French patent FR 2 884 833. Better surface conformation and a better electrical contact between the anode rod and the anode frame are thereby obtained.

If, in order to improve the electrical contact, it is chosen to exert traction or thrust force, the actuator is advantageously a hydraulic jack.

If the force exerted is substantially vertical, it is of advantage to have a tending module which also comprises, integral with said anode handling unit, a means of counter-bracing which, using another actuator, is able to come into contact with the anode framework in the vicinity of the corresponding anode and to exert a reaction force opposed to the force of said activator, so as to maintain the anode frame in place In a first embodiment according to the invention, the actuator jack of the clamp which exerts a substantially vertical force upwards is used, and on the body of the clamp another vertical displacement jack is fixed, the rod end of which comes into contact with the top section of the anode frame, to help it to withstand the local load associated with the rise of the clamp and transmitted by the rod via the contact between rod and anode frame held tight.

If the exerted force is substantially horizontal or oblique, it is of advantage to have a tending module in which said actuator, different from the anode clamp actuator, includes at least one hydraulic jack integral with the anode handling unit, preferably integral with the turret, typically fixed to the clamp body, so that the end of the jack rod can come into contact with a neighboring anode, a protuberance fixed on the anode frame, such as a hook designed to receive the rod of a connector, or a positive riser located in the vicinity of the anode concerned.

Said activator according to the invention can, instead of exerting a force, emit one or more impulses. It will be called a striker in the first case and an impulse generator in the second.

In a first embodiment of this variant, said activator includes at least one striker which follows a trajectory coming within a plane parallel to the contact plane between the anode rod and the anode frame. The striker works in conjunction with an actuator which is preferably a jack, typically a pneumatic jack, raising said striker from a low position where the striker is in contact with the rod, to a high position, the potential gravitational energy stored in this way being used to make the impulse, or to greatly contribute to it (for a propelled striker). Said activator can be either a mass which would be dropped from a certain height, or a mass fixed to the end of an articulated lever pivoting in a plane parallel with the plane of contact between the anode rod and the anode framework. The striker can simply fall under its own weight or be propelled by a second actuator, typically a pneumatic jack. The first and the second actuator can be combined into a double action actuator. For the same impact energy, the propelled striker can to advantage be smaller and lighter then a non-propelled striker.

In a second, preferred embodiment of this variant, the tending module includes an impulse generator carried by the anode clamp and driven by the anode clamp actuator.

Another subject of the invention is a handling clamp, designed to grasp a rod fixed to a load, typically the rod of a prebaked anode designed for the manufacture of aluminum by igneous electrolysis, including:

- at least one mobile clamping part, typically a jaw, having an open position to form an opening, typically turned downwards when in use, in which the rod can be inserted, and a closed position to hold the rod,
- an actuation system, typically a jack in conjunction with a set of tie-rods, to move the mobile clamping component(s) between the open and closed positions,
- characterized in that it also includes an impulse generating device to produce impulses on said rod when said clamp is in contact with said rod.

The clamp according to the invention includes an impulse generating device which generates impulses that are transmitted, directly or by means of other parts of the clamp, to the anode rod via a contact surface. Each one of these impulses is directed so that it causes a relative movement between the anode rod and the anode framework. Preferably, the impulse generator generates impulses directed along a direction parallel to a line included in a vertical plane passing through the electrical contact surface of the anode frame. Each impulse is generated with energy close to, or slightly higher than, a "manual" hammer blow, typically ranging between 100 and 250 joules.

In the case of anodes for aluminum production by igneous electrolysis, the anode rod, which has a substantially square section, appears vertically. When operating manually, a hammer blow is given in a more or less horizontal direction, on a face of the rod perpendicular to the face coming into contact with the anode frame. The impulse generating device can be placed on the clamp so that it also generates impulses on one of the side faces of the rod. But, preferably, the device generates impulses in a direction substantially parallel with the axial direction of the rod. In an embodiment more particularly designed for clamps which, like the anode clamp, grasp the rod in the vicinity of its top end, the device generates impulses on the rod in the vertical direction, towards the bottom, on the top face of the top end of the rod. Such a configuration saves on size and weight.

In general, the anode rod has a substantially horizontal top face and is provided with at least one means of connection, typically a bore. In general, the clamp is provided with a ledge designed to be used as a stop limiting the relative axial movement of the rod in the opening of the clamp. It is also provided with at least one means of connection, typically a projecting finger, on at least one mobile clamping part, typically a "jaw", able to work in conjunction with the corresponding means of connection of the rod. The rod is grasped by the clamp in a succession of stages:

a) the clamp is positioned, in the open position, above the anode rod;
b) the clamp descends vertically until the ledge comes into contact with the top face of the rod;
c) the clamp closes;
d) the clamp rises in closed position: the means of connection of the clamping part comes into contact with the rod and causes it to rise.

The ledge and the means of connection of the mobile clamping part could be designed so that they prevent any axial movement of the rod in the clamp when the clamp is in closed position. But, in a preferred embodiment, the mobile clamping part, with its means of connection, is designed so that it is not in contact with the rod when the top face of the rod is in contact with the ledge. Each impulse generated by the impulse generator can therefore be transmitted in full by the rod to the rod—anode frame contact, without any of the energy of said impulse being dissipated in the clamping part. Advantageously, the ledge is provided with a bore in order to allow the moving part of an impactor to pass, this latter being either the impulse generator itself, or an adaptor transmitting said impulses.

The impulse generator can generate and transmit impulses directly to the rod. In this case, the impulse generator can be placed on said clamp so that it is directly above the top face of the rod when said clamp comes up against the stop on the rod, typically via the ledge.

In general, the clamp consists of two jaws, and the location, above the top face of the rod, for said impulse generator corresponds to a zone adjacent to the pivot or pivots, confined between the jaws when they are in closed position.

In addition to two jaws which open downwards as they pivot around a common is axis (or two neighboring parallel axes), the clamp generally includes an actuation system comprising two tie-rods and an actuator, typically a jack, each rod being connected by the first of its ends to a jaw and by the second end to a common actuation axis (or to two interconnected parallel actuation axes).

According to the first embodiment already described, the impulse generator is placed in the zone located under the pivot, or pivots, confined between the jaws of the clamp when they are in closed position.

According to a second, preferred embodiment, this confined location is reserved for the installation of a locking system, such as that described in French patent FR 2.851.762, which makes it possible to block the clamp in closed position when the rod is in bottom position. The impulse generator is thus placed outside the opening zone of the clamp confined between the jaws, above the pivot axis (or axes) of the jaws and above the jaw actuation system tie-rods. In such a configuration, the impulse generator cannot be in direct contact with the rod and it is made to operate on one of the tie-rods. Said tie-rod is designed so that it comes into contact, directly or via an adaptor, with the top face of the rod when the top face of the rod is in contact with the ledge.

Said adaptor can be part of a locking system, such as that described in patent FR 2.851.762, which makes it possible to block the jaws of the clamp in closed position. For example, the bolt thrust mechanism, referred to as 124 in patent FR 2.851.762, whose bottom face is in constant contact with the top face of the rod, may be chosen and extended upwards so that, when said clamp reaches the stop on the rod, typically via the ledge, the top face of the rod comes into contact with the tie-rod which receives and transmits the impulses.

Advantageously, the jack actuating the jaws of the clamp, instead of being aligned on the vertical axis and acting on the common axis, as in FR 2.851.762, is offset to leave room for the impulse generator and operates the tie-rod which is not in contact with the impulse generator. The impulse generator operates in a slightly tilted direction in relation to the vertical and the top section of the tie-rod subjected to the impulses is advantageously directed perpendicular to this direction.

The impulse generator, which will henceforth also be referred to as the "impact generator" or "impactor", can take the form of a rotating part, which we will call the "active part", able to move in a cylindrical cavity. The active part has a dimension such that its mass is compatible with the energy of the impulse which is to be dissipated (typically, for anode clamps for the production of aluminum by igneous electrolysis, this energy must be in the range 100 to 250 J) The impulse generator can be provided with a spring to provide the force required to accelerate the active part (mechanical impactor). The active part can be made to return by pressure, exerted for example by compressed air, sufficient to oppose the force of the spring. Preferably, because of the desired low spatial requirements, the impulse generator is a kind of pneumatic double-action jack.

In a preferred embodiment, the active part is a piston comprising a flat cylindrical body of large diameter, called an obturator and, attached to the centre of one face of the obturator, a mobile cylindrical axial protuberance, called a "striker", of diameter lower than that of the obturator but high enough to confer to the end of the striker a certain resistance to the impacts which it transmits. The diameter of the obturator is substantially close to that of the cylindrical cavity. The obturator is equipped with leak tight seals around its edge and divides the cylindrical cavity into two distinct chambers. The chamber located on the obturator side is connected to an air tank. The volume of the tank is large compared to that of the chamber, typically more than 10 times greater, so that the air which is in the chamber and the tank is at a substantially constant pressure P1. The chamber located on the striker side is connected to a source of compressed air at pressure P2, greater than P1. Typically, the source of compressed air is the plant compressed air network and the tank is a receptacle which contains a gas at a pressure lower than the network pressure. The chamber located on the striker side is provided with a quick exhaust valve, with a large cross-sectional area, so that the air present in the rod chamber can suddenly move from the P2 pressure to atmospheric pressure.

P1 pressure, higher than atmospheric pressure, is adjusted so that the product of this pressure by the surface area of the obturator is lower than the product of the P2 pressure by the ring-shaped surface resulting from the difference between the surface area of the obturator and the cross-section of the striker. In this way, when the chamber on the striker side is connected to the source of P2 pressure, the active part is pushed back, the air in the chamber located on the obturator side being expelled into the tank.

By opening the quick exhaust valve, the air in the chamber located on the striker side is released, moving suddenly from pressure P2 to atmospheric pressure, and the air in the chamber located on the obturator side, at pressure P1, exerts an acceleration force on the face of the obturator so that the active part acquires kinetic energy which can be used to create an impact. The air tank under pressure P1 and the quick exhaust valve can be offset from the impulse generation device, which, because of this, can be set up in a confined area, which makes it possible to design a compact clamp.

The travel of the active part of the impulse generator is defined so that said active part has acquired the desired amount of kinetic energy when the end of the striker comes into contact with the target (the top face of the rod, or the side of the tie-rod).

Another subject of the invention is a unit for lifting and handling comprising an overhead travelling crane, which can, for example, be moved above and along the electrolysis cells, and a carriage provided with several handling and servicing devices, such as shovels and hoists characterized in that it also includes at least one load handling device provided with a handling clamp as described above and designed, for example, to handle anodes for the production of aluminum by igneous electrolysis.

Another subject of the invention is the use of the tending module according to the invention in a plant producing aluminum by igneous electrolysis, designed in particular for the handling of anodes.

DESCRIPTION OF THE PREFERRED EMBODIMENTS

Vocabulary

Figure 1:
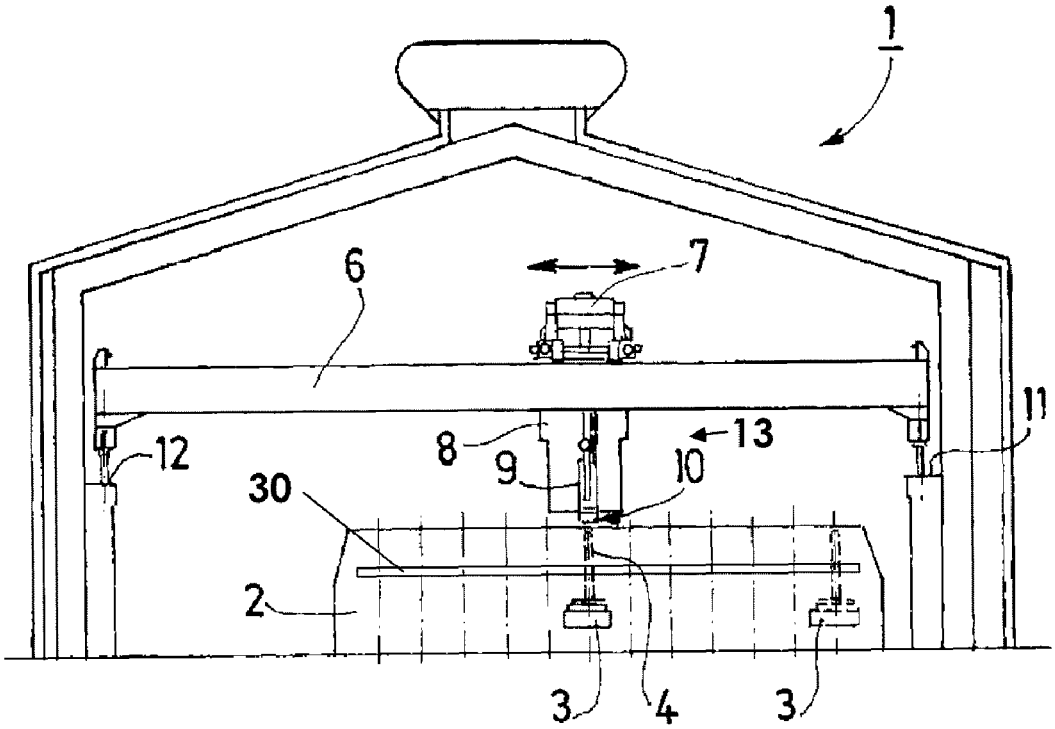
FIG. 1 is a front cross-sectional view of a typical electrolysis building for the production of aluminum.

Electrolysis plants for the production of aluminum include a liquid aluminum production area containing one or more potrooms (1). As illustrated in FIG. 1, each potroom (1) has electrolysis cells (2) and at least one lifting and handling unit or "pot tending machine" (6, 7, 8, 9,10). The electrolysis cells (2) are normally laid out in rows or lines (typically side-by-side or head to head), each row or line typically comprising a hundred, or several hundred cells. Said cells (2) include a series of anodes (3) provided with a metal rod (4) for fixing the anodes and connecting them electrically to a metal anode frame (30). The anode rod (4) is typically of substantially rectangular or square section.

The lifting and handling unit (6, 7, 8, 9, 10) is used to carry out operations on the cells such as a changing an anode or filling the electrolysis cell feed hoppers with crushed bath and $AlF_3$. It can be also used to handle various loads, such as pot parts, ladles of molten metal or anodes. Said unit (6, 7, 8, 9, 10) typically includes an overhead travelling crane (6), a carriage (7) able to move on the overhead travelling crane (6), and handling and servicing devices (often called "tools") (8, 9, 10), such as a cabin (8) for the operator, a shovel or crust shovel (not illustrated), a crustbreaker (not illustrated) or a handling device (9) provided with a clampper or handling clamp (10). This latter device is particularly designed for handling anodes (3), although it can also be used for handling other loads.

The overhead travelling crane (6) rests and circulates on crane rails (11, 12) laid out in parallel with each other and with the main—typically longitudinal—axis of potroom (and the line of cells). The overhead travelling crane (6) can thus be moved along the potroom (1).

Anode Grip

Figure 2:
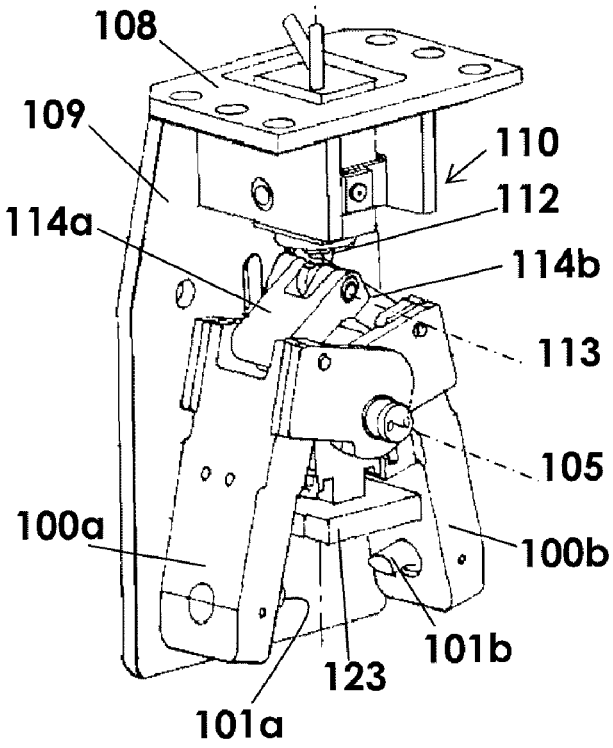
Fig. 2 (prior art)
FIG. 2 shows a perspective view of an anode clamp, representing prior art, provided here with a jaw locking system as in French patent FR 2.851.762.

The handling clamp in prior art, illustrated in FIG. 2, is designed to grasp a rod (4) fixed to a load (3)—typically a carbonaceous block known as an "anode assembly"—and which is provided with a bore (5). In addition to two jaws (100*a*, 100*b*) which open downwards while swiveling around a common axis (105), the clamp includes an actuation system comprising two tie-rods (114*a*, 114*b*) and a jack (112), each tie-rod being connected by the first of its ends to a jaw and by the second end to a common actuation axle (113). The clamp additionally comprises a clamp body (109) and a fixing system (108). This latter is used to fix the clamp to the handling device (9). It also includes a ledge (123) used as stop restricting the relative axial displacement of the rod in the opening of the clamp. Jaws (100*a*, 100*b*) are provided with pawls (101*a*, 101*b*) which fit into the bore (5) of the rod (4) when the clamp is put in closed position.

Example 1

FIG. 3

Figure 3:
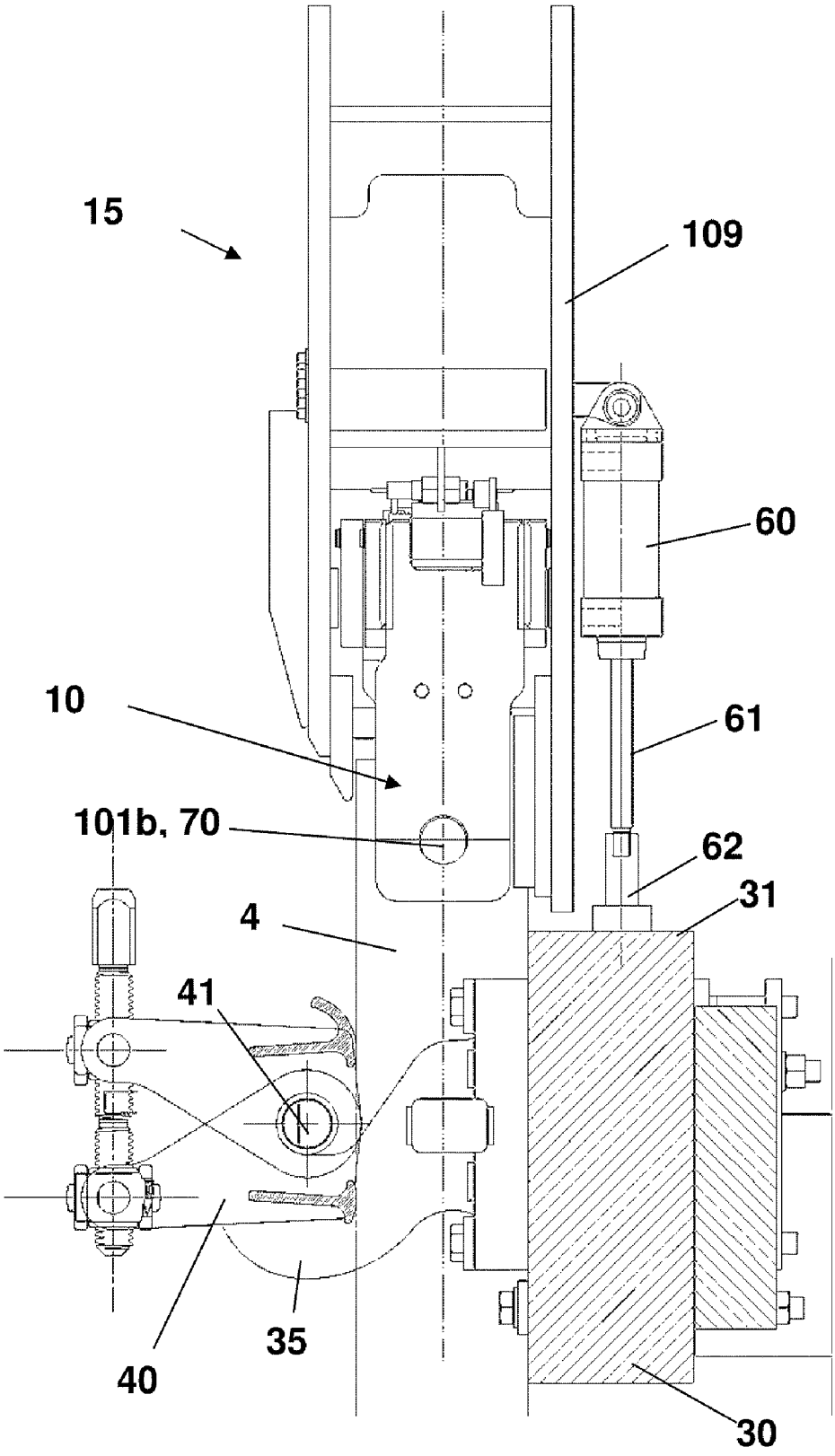
FIG. 3 is a schematic side view of the bottom part of a first tending module according to the invention, acting in the vicinity of the anode frame by exerting a vertical force upwards.
Figure 4:
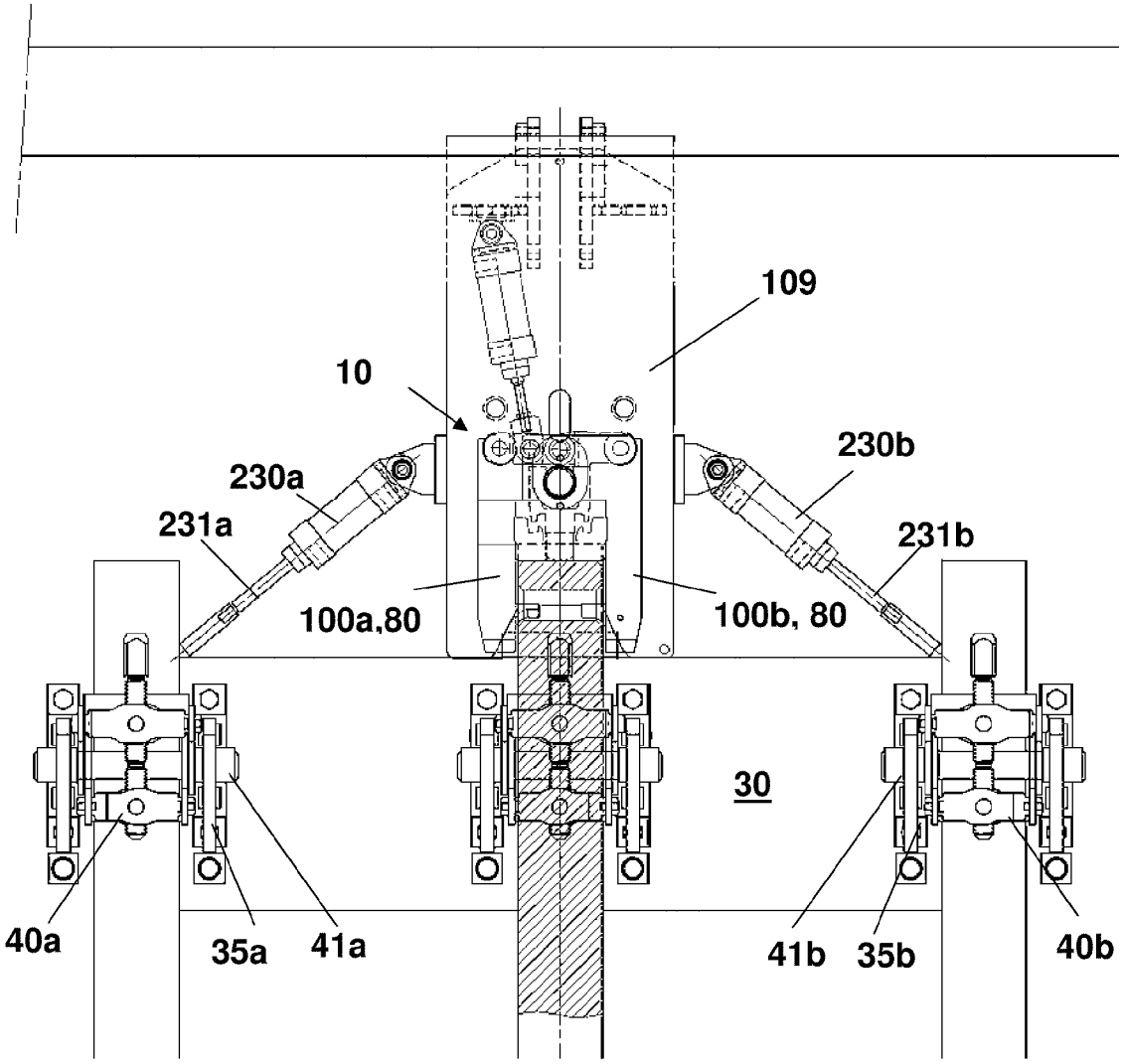
FIG. 4 is a schematic front view of the bottom part of a second tending module according to the invention, acting in the vicinity of the anode frame by exerting an oblique force towards the left then an oblique force towards the right (or vice versa) on the middle rod.
Figure 5:
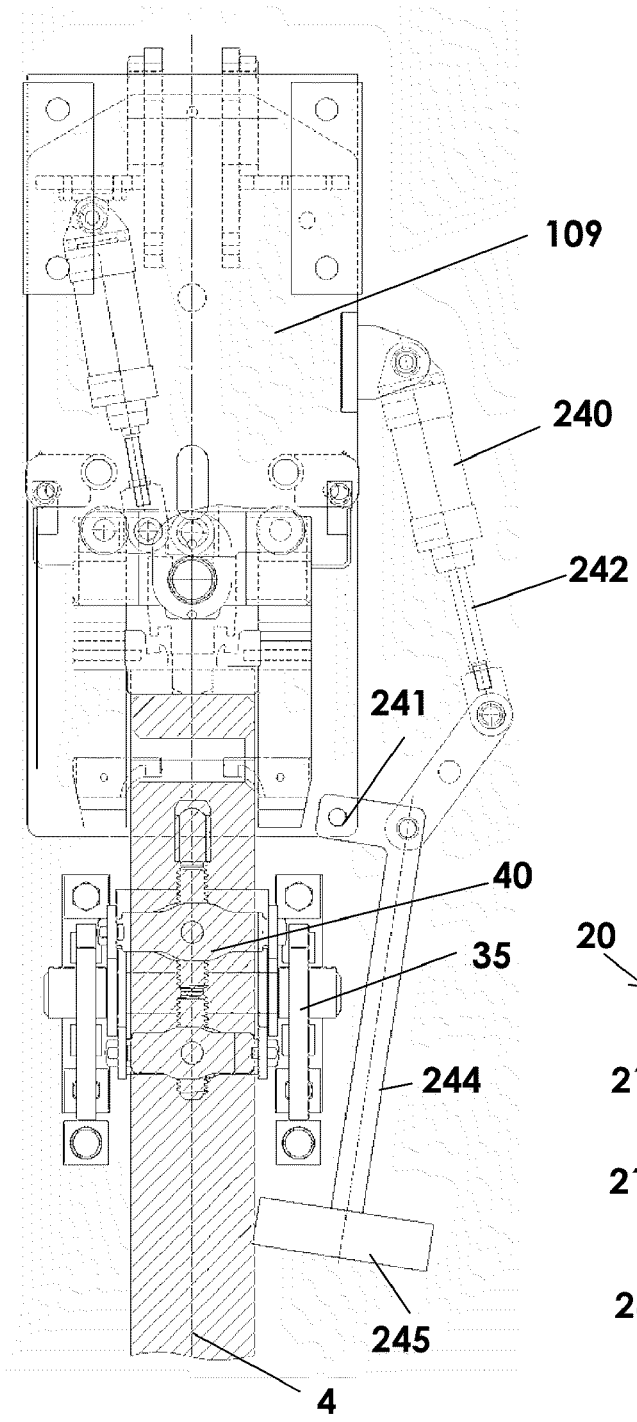
FIG. 5 is a schematic front view of the bottom part of a third tending module according to the invention, acting in the vicinity of the anode frame by sending a side impulse onto the rod

FIG. 3 gives a side view of the bottom section of a tending module, located in the vicinity of the anode frame (30), a clamp (10) assembled on a vertical arm (15). The illustration, like that of FIGS. 4 and 5, is schematic in the sense that when the anode is replaced, the top end of the rod of the new anode is much further away from the anode frame than what is drawn here. The clamp (10) grasps the rod (4), which is firmly plated against the anode frame (30) by means of a connector (40). The activator (70) is the clamp itself which is actuated vertically upwards by the arm (15) and drives the rod (4), via the is pawls (101*a*, 101*b*). To prevent the anode frame (30) from being locally moved by the force thus exerted on the rod (4), a hydraulic jack (60) is fitted to the clamp body (109), so that its rod (61) can move vertically downwards. The end of the jack rod (61) has an end-piece (62) which comes into contact with the top section (31) of the anode frame, to help it to withstand the local force generated by the arm and transmitted by the rod through the contact between the anode rod and the anode frame.

Example 2

FIG. 4

FIG. 4 is a front view, of the bottom part of a second tending module according to the invention, of an anode clamp (10) acting in the vicinity of the anode frame (30) by exerting an oblique force towards the left then an oblique force towards the right (or vice versa, depending on the order in which the actuators are actuated). The activator (80) is here again the clamp itself, or more accurately one of its jaws (100*a*) or (100*b*), which is actuated by a hydraulic jack (230*a*, 230*b*) assembled integral with the clamp body (109). The end of the rod (231*a*, 231*b*) of the hydraulic jack is here illustrated schematically. It is provided with an end-piece designed to rest on the hook (35*a*, 35*b*) integral with the anode frame (30) and designed to receive the rods (41*a*, 41*b*) of the connector (40*a*, 40*b*) of an adjacent anode (rods 4*a*, 4*b*).

With such a configuration, the relative movement between contact surfaces of the anode rod and the anode frame substantially results in a rotation around a point located in the middle of the contact surface. A single jack could suffice but the symmetrical configuration illustrated in this example makes it possible to minimize the scale of movements and to return easily to the initial position.

Example 3

FIG. 5

FIG. 5 is a schematic front view of the bottom part of a third tending module according to the invention, acting in the vicinity of the anode frame by sending a side impulse onto the rod The activator is a striker (245) falling under its own weight, along a trajectory located in a plane parallel with the plane of contact between the anode rod and the anode frame (not shown) The actuator is a pneumatic jack (240) which, as it goes up the jack rod (242), lifts the lever (244) on which said striker (245) is mounted, from a low position where the striker is in contact with the rod to a high position, the potential gravitational energy thus stored being used to make the impulse. The arm (244) is hinged around the fixed point (241) integral with the clamp body (109). By suddenly lowering the pressure in the pneumatic jack (240), the striker (245), under the influence of gravity, causes the lever (244) to swivel and strike one side of the rod (4).

In a variant, the pneumatic jack (240) is designed so that air can be blown in by the jack rod, which accelerates the mass of the striker (245) on starting: this gives an energy boost providing a stronger impact. A lighter and smaller striker can also be designed, able to transmit an impulse as strong as the unpropelled striker (245. In this embodiment, the jack (240) has a double action: as a first actuator to raise the striker and as a second actuator to propel it towards the rod.

Examples 4 and 5

FIGS. 6 to 9

Figure 6:
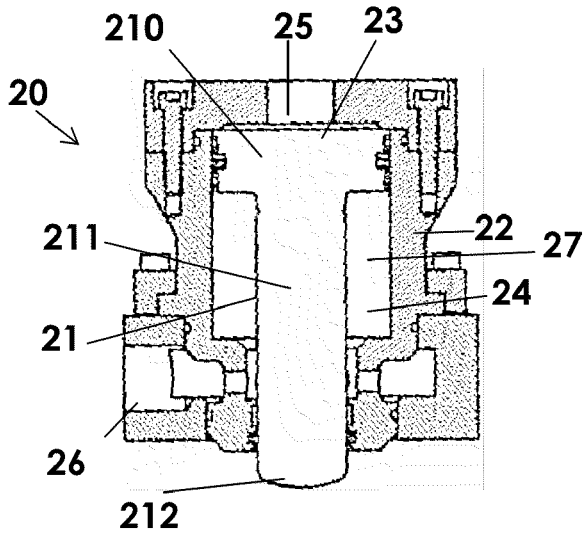
FIG. 6 is a front view of an impulse generating device.
Figure 7:
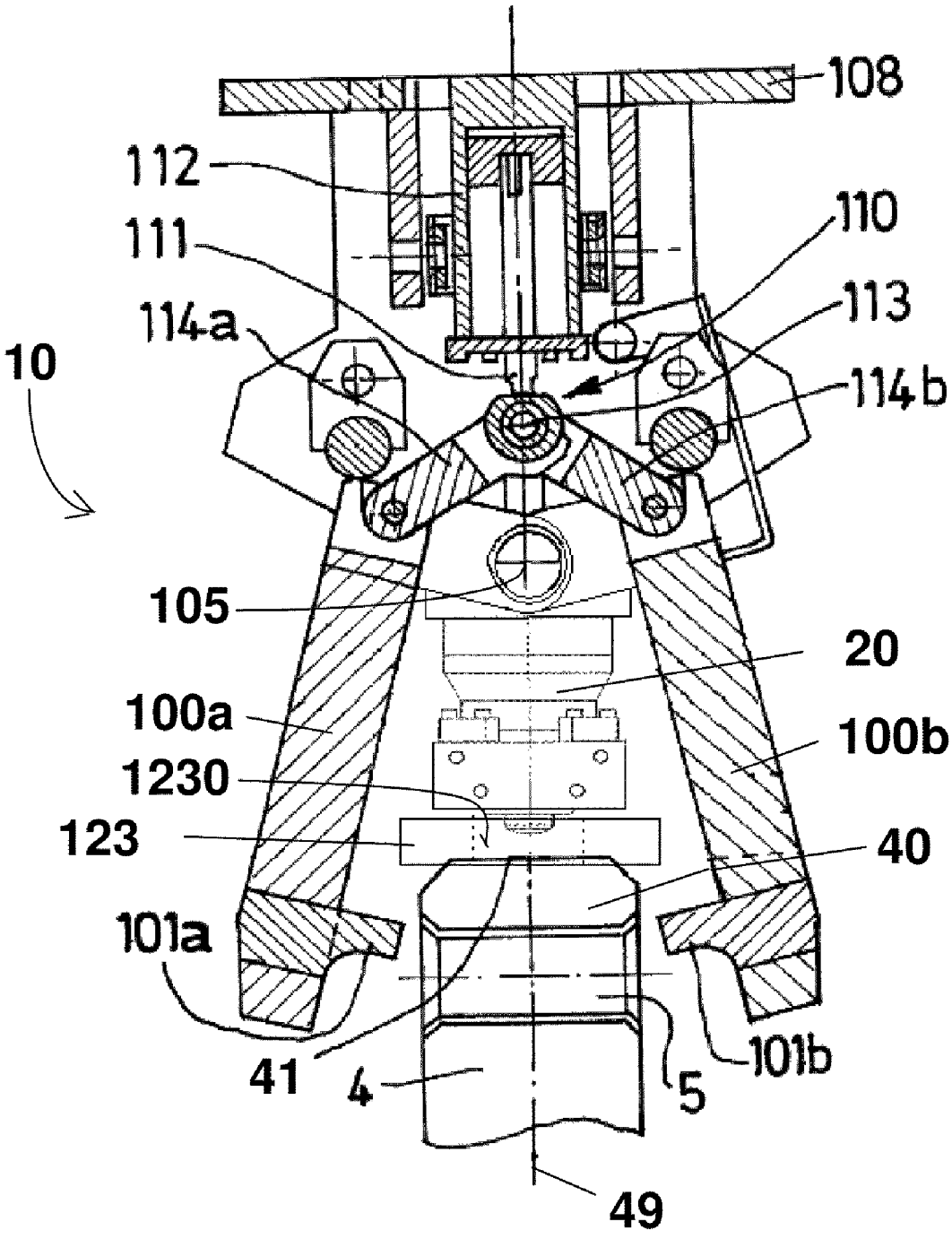
FIG. 7 is a front view of the clamp of a fourth tending module according to the invention, provided with an impulse generating device designed to be applied directly to the top face of the anode rod.

The tending modules in the following examples are provided with an anode clamp (10, 10') equipped with an impulse generating device (20, 20'), built on the principle of the double action pneumatic jack, as illustrated in FIG. 6.

The active part (21) is a rotating part, able to move in the cylindrical cavity (27) of a compartment (22). This is a piston comprising a flat cylindrical body (210) of large diameter, called an obturator and, attached to the centre of one face of the obturator, a mobile cylindrical axial protuberance, that we shall call a "striker", of diameter lower than that of the obturator but high enough to confer to the end of the striker a certain resistance to the impacts which it transmits. The diameter of the obturator is substantially close to that of the cylindrical cavity of the compartment. The obturator is equipped with leak tight seals around its edge and divides the tube into two distinct chambers. The chamber (23) located on the obturator side is connected, via opening (25) to an air tank (not shown). The volume of the tank is large compared to that of the chamber, typically more than 10 times greater, so that the air which is in the chamber and the tank is at a substantially constant pressure P1. The chamber (24) located on the striker side (211) is connected to the plant compressed air network by the conduit 26. This latter, with a large cross-sectional area, is provided with a quick exhaust valve (external to the device, and not shown), which makes it possible to cut off the junction with the source of compressed air and to connect the inside of the chamber 24 with the outside, so that the air in the chamber on the striker side (211) can suddenly move from the compressed air network pressure to atmospheric pressure.

P1 pressure, higher than atmospheric pressure, but lower than the network pressure, is adjusted so that the product of this pressure by the surface area of the obturator (210) is lower than the product of the P2 pressure by the ring-shaped surface resulting from the difference between the surface area of the obturator (210) and the cross-section of the striker (211). In this way, when the chamber (24) on the striker side is connected to the network pressure source, the active part (21) is pushed back, the air in the chamber (23) located on the obturator side being expelled into the tank.

By opening the quick exhaust valve, the air in the chamber (24) located on the striker side is released, moving suddenly from network pressure to atmospheric pressure, and the air in the chamber (23) located on the obturator side, at pressure P1, exerts an acceleration force on the face of the obturator (210) so that the active part (21) acquires kinetic energy which can be used to create an impact. The air tank under pressure P1 and the quick exhaust valve are offset from the impulse generation device, which, because of this, can be set up in a confined area, which makes it possible to design a compact clamp.

Example 4

FIG. 7

The clamp (10) in this example is designed to grasp an anode rod (4) provided with a bore (5). In addition to two jaws (100*a*, 100*b*) which open downwards while swiveling around a common axis (105), the clamp includes an actuation system comprising two tie-rods (114*a*, 114*b*) and a jack (112), each tie-rod being connected by the first of its ends to a jaw and by the second end to a common actuation axle (113) connected to the actuator rod (111) of the jack (112). The jaws have an open position which forms an opening in which the anode rod (4) can be inserted until its top face (41) comes up against the ledge (123), and a closed position in which the pawls (101*a*, 101*b*) of the jaws (100*a*, 100*b*) hold the rod. The actuation system (110) is used to move the jaws (100*a*, 100*b*) between the open and closed positions.

The rod (4) is grasped by the clamp (10) in a succession of stages:

a) the clamp is positioned, in the open position, above the anode rod;
b) the clamp descends vertically until the ledge (123) comes into contact with the top face (41) of the rod (4);
c) the clamp closes: pawls (101*a* and 101*b*) are inserted inside the bore (5) of the rod. Their length is such that they do not touch said bore when the ledge (123) is in contact with the top face (41) of the rod.
d) the clamp rises in closed position: pawls (101*a* and 101*b*) come into contact with the wall of the bore (5) and cause the rod to rise with the clamp.

The clamp (10) also includes a device (20) which generates impulses when the face of support (123) is in contact with the top face (41) of the rod. The device (20) generates impulses in a direction substantially parallel with the axial direction (49) of the rod (4), downwards, on the top face (41) of the top end (40) of the rod. The ledge (123) is provided with a bore (1230) which allows the moving part (211) of the impactor (20) to move so as to reach the top face (41) of the anode rod. The impactor (20) is placed in the zone located under the fulcrum axis (105) of the jaws (100*a*, 100*b*). The dimensions of the impulse generator must be adapted to those of this zone, which is confined between the jaws of the clamp.

Example 5

Figure 8:
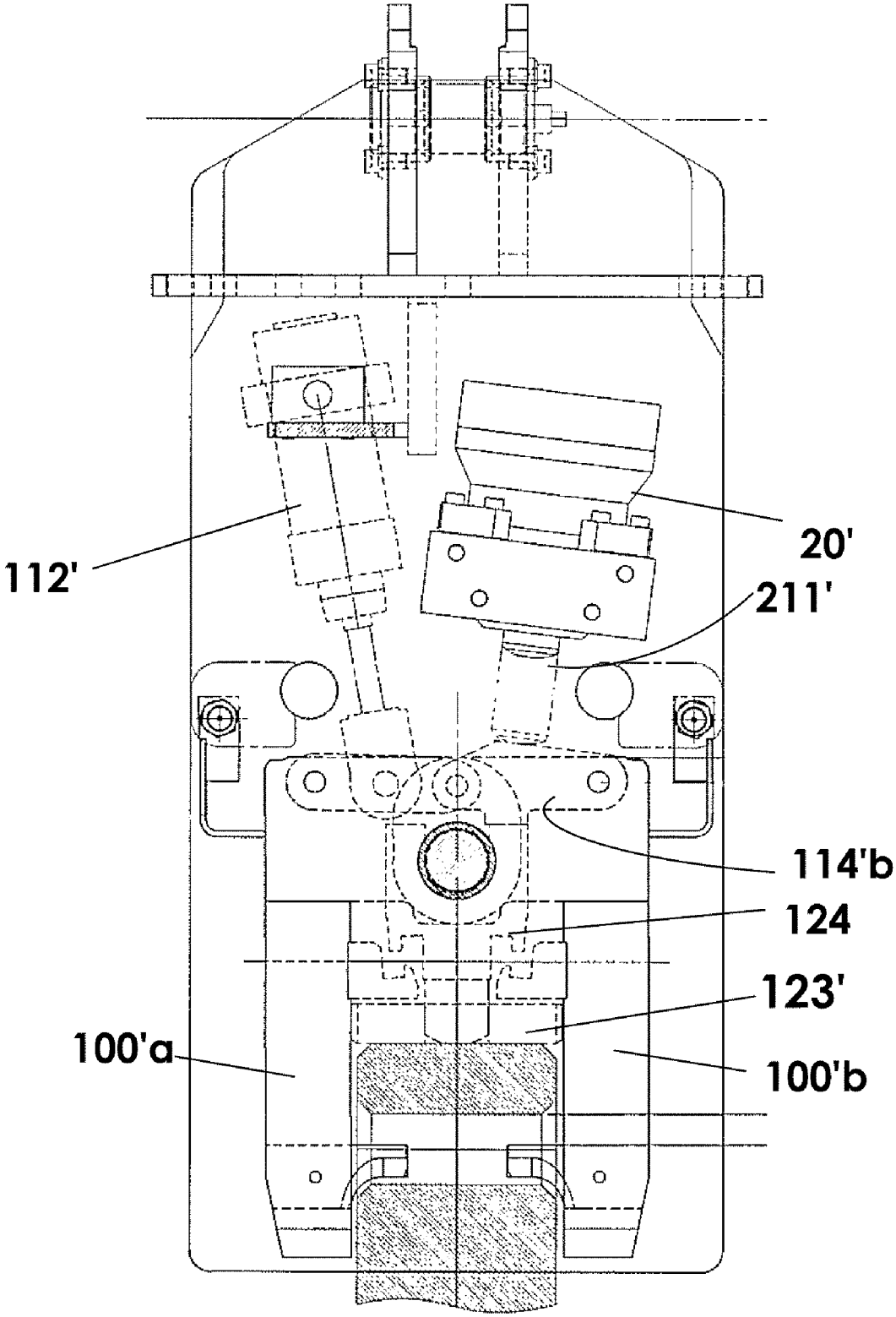
FIGS. 8 and 9 are front views of the clamp of a fifth tending module according to the invention, provided with an impulse generating device and a jaw locking system.
Figure 9:
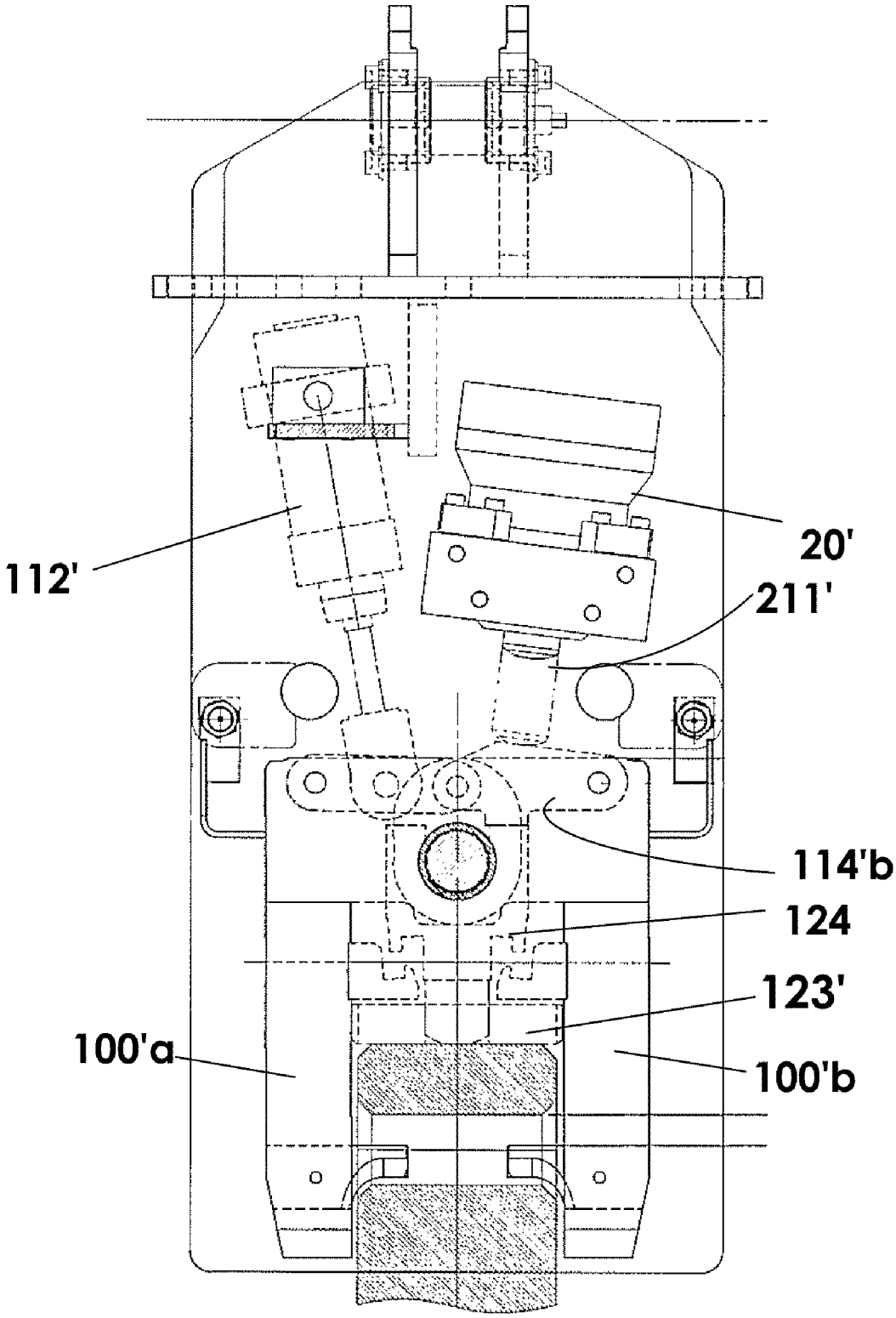

FIGS. 8 and 9

The clamp (10) in example 2 is also designed to grasp an anode rod (4) provided with a bore (5). In addition to two jaws (100'*a*, 100'*b*) which open downwards while swiveling around a common axis (105'), the clamp includes an actuation system (110') comprising two tie-rods (114'*a*, 114'*b*) and a jack (112'), each tie-rod being connected by the first of its ends to a jaw and by the second end to a common actuation axle (113') connected to the actuator rod (111') of the jack (112').

As in the previous example, the jaws have an open position which forms an opening in which the anode rod (4) can be inserted until its top face (41) comes up against the ledge (123'), and a closed position in which the pawls (101'*a*, 101'*b*) of the jaws (100'*a*, 100'*b*) hold the rod. The actuation system (110') is used to move the jaws (100'*a*, 100'*b*) between the open and closed positions. As the clamp closes, the pawls (101'*a* and 101'*b*) are inserted inside the bore (5) of the rod. Their length is such that they do not touch said bore when the ledge (123') is in contact with the top face (41) of the rod.

The clamp (10') also includes a device (20') which generates impulses when the face of support (123') is in contact with the top face (41) of the rod (4). The device (20') generates impulses in the vertical direction, downwards, on the top face (41) of the top end (40) of the rod (4). It is here placed outside the opening zone of the clamp confined between the jaws, above the fulcrum axis (105') of the jaws and above the jaw actuation system (110') tie-rods (114'*a*, 114'*b*). In such a configuration, the impulse generator cannot be in direct contact with the rod and it is made to operate, by means of the striker (211'), on the tie-rod (114'*b*) which is designed so that it comes into contact by means of an adaptor (124), with the top face (41) of the rod when the clamp is in closed position.

Said adaptor is here the bolt thrust mechanism (124), as described in patent FR 2 851 762, which makes it possible to block the jaws of the clamp in closed position. When the clamp arrives in the vicinity of the anode rod to grasp it, it is the bottom face (1242) of this thrust mechanism which comes into contact with the top face (41) of the rod. The thrust mechanism is here extended upwards so that its top face (1241) is brought into contact, when the clamp is in closed position, with a protuberance (1142) worked onto the bottom section of the rod (114'*b*) which undergoes and transmit the impulses.

The jack (112') is not aligned on the vertical axis but offset, so that the impulse generator (20') can be placed beside it, at about the same height. It operates the rod (114'*a*) which is not subjected to the impulses of the striker (211'). The impulse generator operates in a slightly tilted direction in relation to the vertical, and the top section (1141) of the tie-rod (114'*b*) subjected to the impulses is advantageously directed perpendicular to this direction.

The invention claimed is:

1. A tending module for a series of electrolysis cells constructed and arranged for the manufacture of aluminum by igneous electrolysis, each cell comprising a series of anodes provided with a metal rod which fixes and electrically connects the anodes to a metal anode frame by means of contact surfaces on the rod and the frame, said tending module comprising:

a frame constructed and arranged to be fixed to a mobile component;

at least one anode handling unit connected to said frame; and an activator integral with said anode handling unit, constructed and arranged to exert at least one force or impulse on the anode rod, with an intensity sufficient to move the contact surfaces of the rod and the frame in relation to each other by an amount sufficient to improve electrical contact therebetween, while the rod is firmly maintained in contact against the frame.

2. A tending module according to claim 1, wherein the anode rod and the frame each has a plane face for contacting each other, defining thereby a contact plane, and wherein said activator exerts a force or emits an impulse directed in a plane parallel to the contact plane.

3. A tending module according to claim 2, wherein said activator includes at least one striker configured to follows a trajectory within a plane parallel to the contact plane between the rod and the anode frame, and wherein the actuator comprises a jack raising said striker from a low position where the striker is in contact with the rod to a high position, potential gravitational energy being stored thereby being used to make the impulse.

4. A tending module according to claim 3, wherein said activator is assembled on an articulated lever swiveling in the plane parallel to the contact plane between the rod and the anode frame.

5. A tending module according to claim 3, wherein the activator is arranged to fall into the tending module as a result of its own weight.

6. A tending module according to claim 3, additionally comprising a second actuator arranged to provide an impulse to propel said activator toward the anode rod.

7. A tending module according to claim 1, wherein said activator is driven by at least one actuator configured for movement from a position in which said activator is not in contact with the anode rod to a position where said activator is in contact with the anode rod, and/or is configured for an opposite movement.

8. A tending module according to claim 7, wherein the activator exerts a substantially horizontal or oblique force, and the actuator includes at least one hydraulic actuating cylinder with a jack rod assembled to be integral with said anode handling unit, such that an end of the jack rod is arranged to come into contact with an adjacent anode, a protuberance fixed on the anode frame, or a positive riser located in the vicinity of the anode concerned.

9. A tending module according to claim 1, wherein the anode handling unit includes at least one anode clamp integral with said activator.

10. A tending module according to claim 9, wherein said activator is carried by the anode clamp, and wherein the actuator is an anode clamp actuator used for handling the anodes.

11. A tending module according to claim 10, wherein said activator comprises an impulse generating device integral with the anode clamp.

12. A tending module according to claim 1, wherein the activator exerts a substantially vertical force, the module further comprising, integral with said anode handling unit, a means of counter-bracing which, using another actuator, is configured for coming into contact with the anode frame in the vicinity of the corresponding anode, and exerting a reaction force opposed to the force of said activator.

13. A lifting and handling unit comprising the tending module according to claim 1.

14. A handling clamp constructed and arranged to grasp a rod of a prebaked anode for the manufacture of aluminum by igneous electrolysis, comprising:

at least one mobile clamping part having an open position to form an opening for insertion the rod, and a closed position for holding the rod, and an actuation system constructed and arranged to move the at least one mobile clamping part between the open and closed positions, the actuation system further comprising an impulse generating device producing impulses on the rod when the clamping part is in contact with the rod.

15. A handling clamp according to claim 14, wherein said impulse generating device generates impulses in a direction parallel to a line included in a vertical plane passing through a surface of anode framework in contact with the anode rod.

16. A handling clamp according to claim 15, wherein said impulse generating device generates impulses on the rod in a direction substantially parallel with an axial direction of the rod.

17. A handling clamp according to claim 16, wherein said at least one mobile clamping part is constructed and arranged to grasp the rod in the vicinity of a top end and the impulse generating device generates impulses in the axial direction, on a top face of a top end of the rod.

18. A handling clamp according to claim 14, additionally comprising a ledge serving as a stop limiting relative axial movement of rod in the opening of the clamp and with at least one means for connection, on the at least one mobile clamping device, constructed and arranged to work in conjunction with a means for connection of the rod, said at least one mobile clamping device, provided with said means for connection, being configured such that the at least one mobile clamping device is not in contact with rod when a top face of the rod is in contact with the ledge.

19. A handling clamp according to claim 18, wherein said ledge is provided with a bore to allow the moving part of an impactor to pass, the impactor being either the impulse generating device, or an adaptor transmitting impulses.

20. A handling clamp according to claim 14, wherein the impact generating device is configured to generate impulses with an impact energy of between 100 and 250 J.

21. A handling clamp according to claim 14, wherein said impulse generating device is configured to be is placed on said clamp such that the impulse generating device is directly above a top face of the rod when said clamp comes up against a stop on the rod.

22. A handling clamp according to claim 14, additionally comprising an actuation system comprising two tie-rods and an actuator, each of the tie-rods being connected by a first end to a jaw and by a second end to a common actuation axle, wherein the impulse generating device is placed above a fulcrum of the jaws and above the tie-rods of the jaw actuation system to act on one of the rods, the impulse generating device being constructed and arranged to come into contact, directly or via an adaptor, with a top face of the rod when said clamp comes up against a stop on the rod.

23. A handling clamp according to claim 22, further comprising a locking system, wherein said adaptor is a part of the locking system.

24. A handling clamp according to claim 14, wherein said impulse generating device includes an active part constructed and arranged to move in a cylindrical cavity, said active part comprising an obturator of diameter substantially close to that of said cylindrical cavity, and, attached to a center of one face of the obturator, a cylindrical axial protuberance of smaller diameter, said obturator dividing said cylindrical cavity into two distinct chambers, one said chamber located on the obturator side being connected to an air tank, so that the air which is in the chamber and the tank are under a substantially constant pressure P1, and the other said chamber is located on the axial protuberance side being connected to a compressed air source at a pressure P2, higher than P1.

25. A handling clamp according to claim 24, wherein said chamber located on said axial protuberance side is also connected to a quick exhaust valve via a wide opening.

26. A handling clamp according to claim 24, wherein said air tank and said quick exhaust valve are offset in relation to the impulse generating device.

27. A lifting and handling unit comprising at least one load handling device provided with a handling clamp according to claim 14.

* * * * *